US011006726B1

(12) United States Patent
Liu

(10) Patent No.: US 11,006,726 B1
(45) Date of Patent: May 18, 2021

(54) APPLICATOR WITH ROLLER-BALLS

(71) Applicant: Ting Nan Liu, New Taipei (TW)

(72) Inventor: Ting Nan Liu, New Taipei (TW)

(73) Assignee: Zhuhai Ding Rong Plastic Products Co., LTD, Zhuhai (CN)

( * ) Notice: Subject to any disclaimer, the term of this patent is extended or adjusted under 35 U.S.C. 154(b) by 13 days.

(21) Appl. No.: 16/739,284

(22) Filed: Jan. 10, 2020

(51) Int. Cl.

| | |
|---|---|
| ***B43K 7/00*** | (2006.01) |
| ***A45D 34/04*** | (2006.01) |
| ***B05C 17/02*** | (2006.01) |
| ***A45D 40/26*** | (2006.01) |

(52) U.S. Cl.
CPC ..... *A45D 34/041* (2013.01); *A45D 40/261* (2013.01); *B05C 17/02* (2013.01); *A45D 2200/10* (2013.01)

(58) Field of Classification Search
CPC ..... A45D 34/041; A45D 40/261; B05C 17/02
USPC ..... 401/209, 213
See application file for complete search history.

(56) References Cited

U.S. PATENT DOCUMENTS 10,244,844 B2 * 4/2019 Lee ..... B05C 17/00569
2012/0121309 A1 * 5/2012 Liu ..... A61H 15/0085 401/6
2016/0310728 A1 * 10/2016 Cazares Delgadillo ..... A45D 34/041

* cited by examiner

*Primary Examiner* — Jennifer C Chiang

(57) ABSTRACT

An applicator includes a closure cap including inner retaining members; an application head including a housing, a support, and a coupling member wherein the housing includes an axial channel with the support substantially disposed therein, an inclined surface having an application face and holes, and roller-balls disposed in the holes respectively; the support includes a stair adjacent to the holes, and the coupling member includes a neck member at a first end and being urged against the support, an internally threaded member adjacent to a second end and disposed through the neck member, a mating retaining member disposed on an outer surface of the neck member between the inclined surface and the internally threaded member, the mating retaining member being secured to the retaining members; and a container assembly including an externally threaded neck at one end and threadedly secured to the internally threaded member.

6 Claims, 7 Drawing Sheets

APPLICATOR WITH ROLLER-BALLS

BACKGROUND OF THE INVENTION

1. Field of the Invention

The invention relates to applicators and more particularly to an applicator having a plurality of roller-balls disposed in an application face of an inclined surface of a releasable application head so that dispensed fluid material can be evenly distributed on the body parts by applying and the application head can be detached to clean.

2. Description of Related Art

There are many conventional applicators having a plurality of roller-balls rotatably disposed on a top of a housing. In use, dispensed fluid material flows to an opening disposed among the roller-balls. A user may rotate the roller-balls to apply the fluid material to the body parts.

However, microorganisms may grow on the roller-balls after the roller-balls have contacted the skin. Further, it is impossible of using water or alcohol to clean the roller-balls because the opening is disposed among the roller-balls. User typically uses a facial tissue to clean the roller-balls and this is disadvantageous because it is not effective, cotton bits may be left on the roller-balls, and it is not economical.

Thus, the need for improvement still exists.

SUMMARY OF THE INVENTION

It is therefore one object of the invention to provide an applicator comprising a closure cap including a plurality of retaining members on an inner surface; an application head including a housing, a support, and a coupling member wherein the housing includes an axial channel with the support substantially disposed therein, an inclined surface having an application face and a plurality of holes, and a plurality of roller-balls disposed in the holes respectively; the support includes a stair adjacent to the holes, and the coupling member includes a neck member at a first end, the neck member being urged against the support, an internally threaded member adjacent to a second end and disposed through the neck member, a mating retaining member disposed on an outer surface of the neck member between the inclined surface and the internally threaded member, the mating retaining member being secured to the retaining members; and a container assembly including an externally threaded neck at one end; wherein the internally threaded member is configured to thread into engagement with the externally threaded neck.

The invention has the following advantages and benefits in comparison with the conventional art: the application head can be detached from a bottle of the container assembly to be used individually. In use, a user may detach the application head. Next, may squeeze the bottle to dispense a fluid material. Next, the application head and the bottle are joined by threading. Thereafter, a user may rotate the roller-balls to apply the dispensed fluid material on the body parts while massaging same. After the application, the user may detach the application head from the bottle again. Finally, the user may clean the housing. Otherwise, microorganisms may grow on the roller-balls. Moreover, the application face is provided on the inclined surface so that the dispensed fluid material can be evenly distributed on the body parts by applying.

The above and other objects, features and advantages of the invention will become apparent from the following detailed description taken with the accompanying drawings.

DETAILED DESCRIPTION OF THE INVENTION

Figure 1:
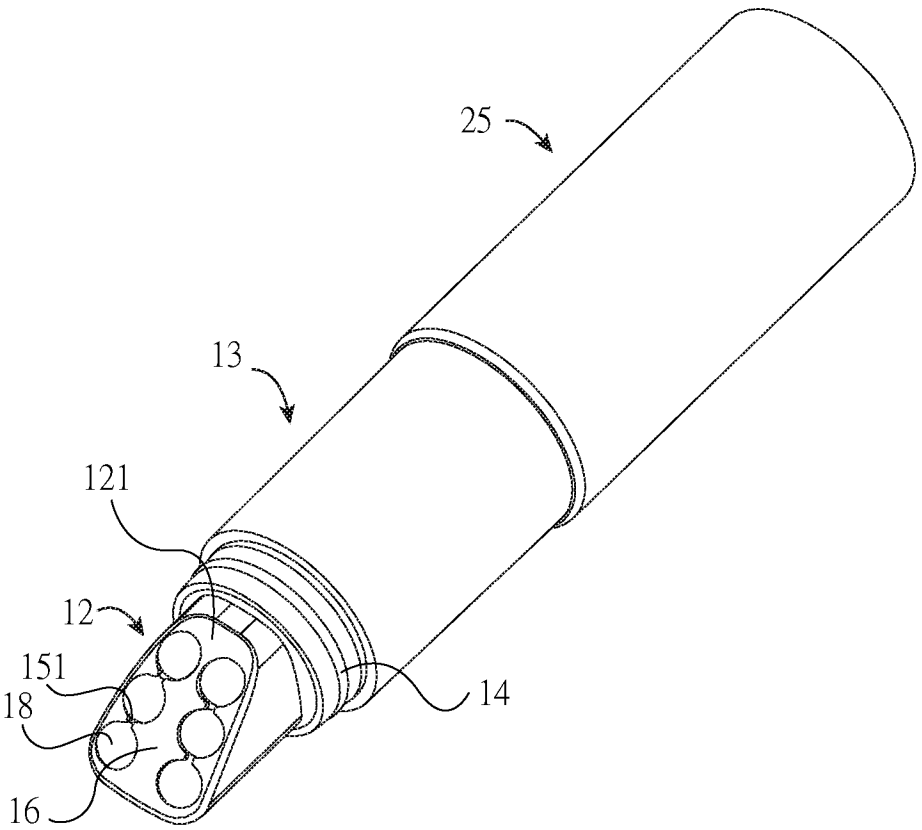
FIG. 1 is a perspective view of an applicator according to a first preferred embodiment of the invention.
Figure 2:
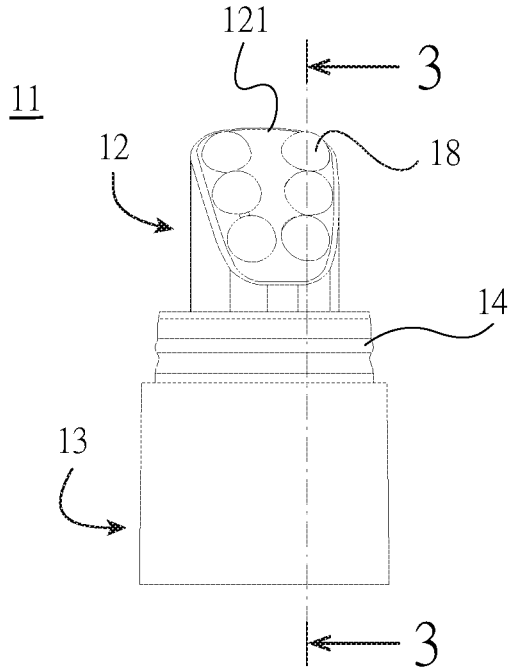
FIG. 2 is a side elevation of an upper portion of the applicator.
Figure 3:
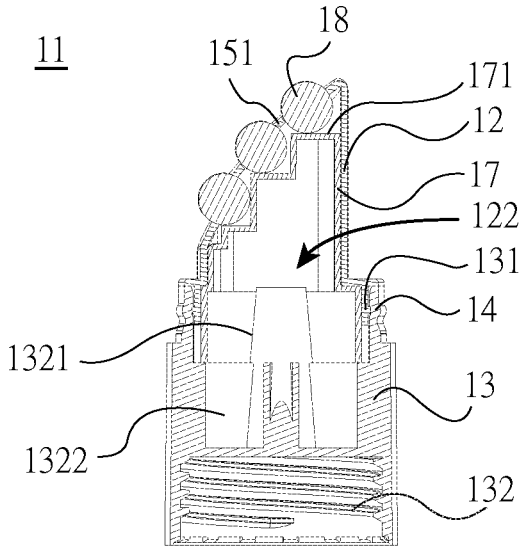
FIG. 3 is a sectional view taken along line 3-3 of FIG. 2.

Referring to FIGS. 1 to 4, an applicator in accordance with a first preferred embodiment of the invention comprises a closure cap 10, an application head 11 and a container assembly 20 as discussed in detail below.

The closure cap 10 includes a plurality of retaining members 101 on an inner surface. The application head 11 includes a housing 12, a support 17, and a coupling member 13. The housing 12 includes an inclined surface 121 having a plurality of holes 15 with a plurality of roller-balls 18 disposed therein respectively, an axial channel 122, the support 17 having most portions disposed in the channel 122 and having a stair 171 with a plurality of levels adjacent to the holes 15 respectively, and the coupling member 13 including a neck 131 at a first end, an internally threaded member 132 adjacent to a second end, an axial rod 1321 having a plurality of equally spaced blades 1322 on a surface urging against an end of the support 17 which is disposed through the neck 131, a mating retaining member 14 formed on an outer surface of the neck 131 between the inclined surface 121 and the internally threaded member 132, the mating retaining member 14 being secured to the retaining members 101. The container assembly 20 includes a discharging member 21 having an intermediate annular flange 211, a conic discharging collar 212 extending from the flange 211 to terminate at a first end, the discharging collar 212 defining an opening 213, a main section 215 at a second end, and a fastening element 214 between the flange 211 and the main section 215; a hollow cylindrical body 24 defining an axial space 242 and having an externally extending rim 241 at a first end, the rim 241 being securely put on the fastening element 214, a decreased diameter channel 243 at a second end, and a check valve 244 through the decreased diameter channel 243; a torsion spring 23 disposed in the space 242 and put on the main section 215; and a bottle 25 having an internal space 251 for containing a fluid material, and an externally threaded neck 26 at one end. The internally threaded member 132 is clockwise threaded into engagement with the externally threaded neck 26.

As shown in FIGS. 2 to 5 specifically, the housing 12 and the coupling member 13 are secured together. The roller-balls 18 are disposed in the holes 15. The support 17 is engaged with the roller-balls 18 to securely hold the roller-balls 18 in the holes 15. In the first embodiment, a wall 172 is provided on the stair 171 to divide each level of the stair 171 into left and right units aligned with the holes 15 respectively. Thus, the roller-balls 18 are arranged as two separate rows. Preferably, the inclined surface 121 is made of polypropylene (PP) which is a thermoplastic polymer. Thus, the inclined surface 121 is somewhat flexible with the roller-balls 18 securely retained therein.

Figure 4:
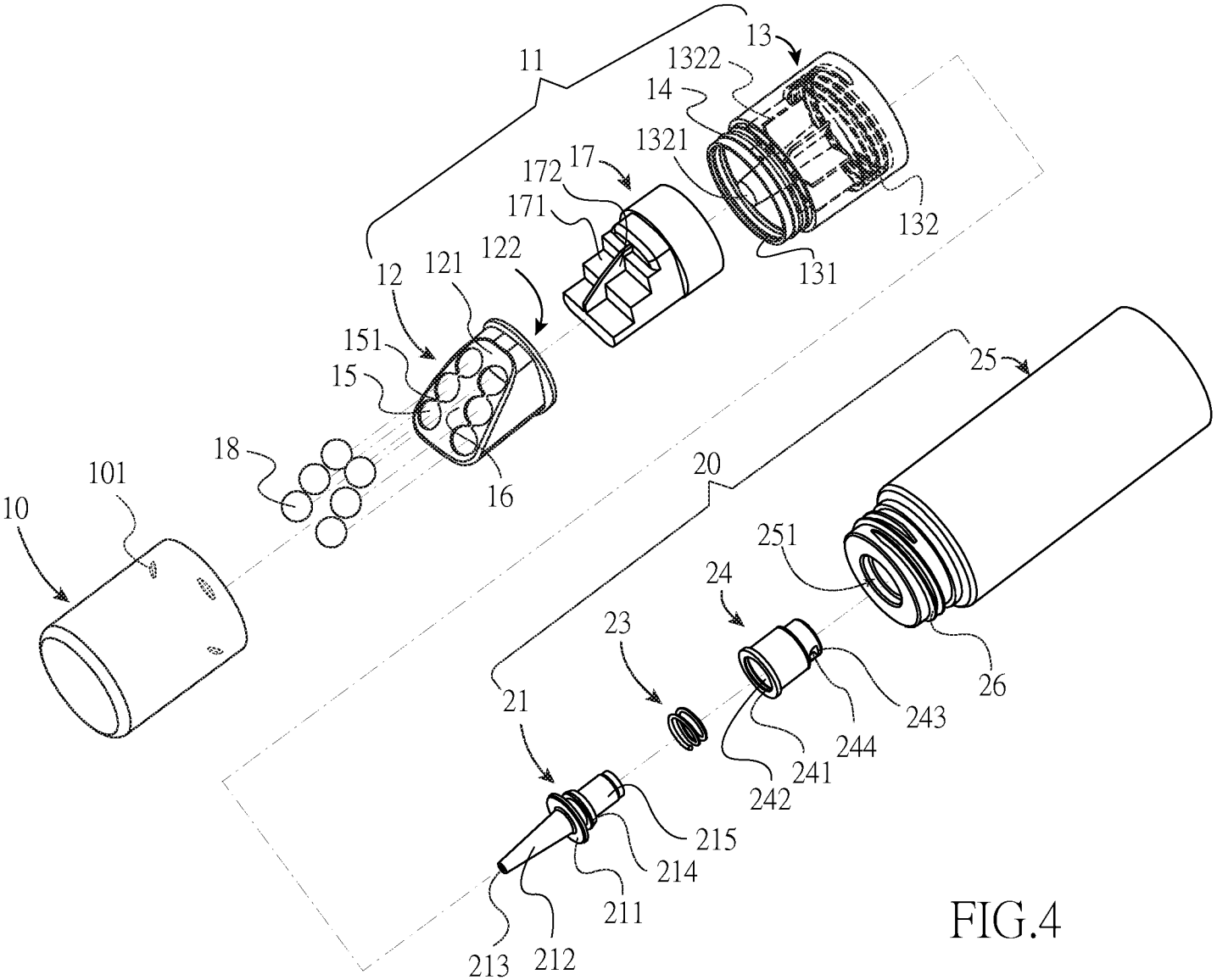
FIG. 4 is exploded view of the applicator.
Figure 6:
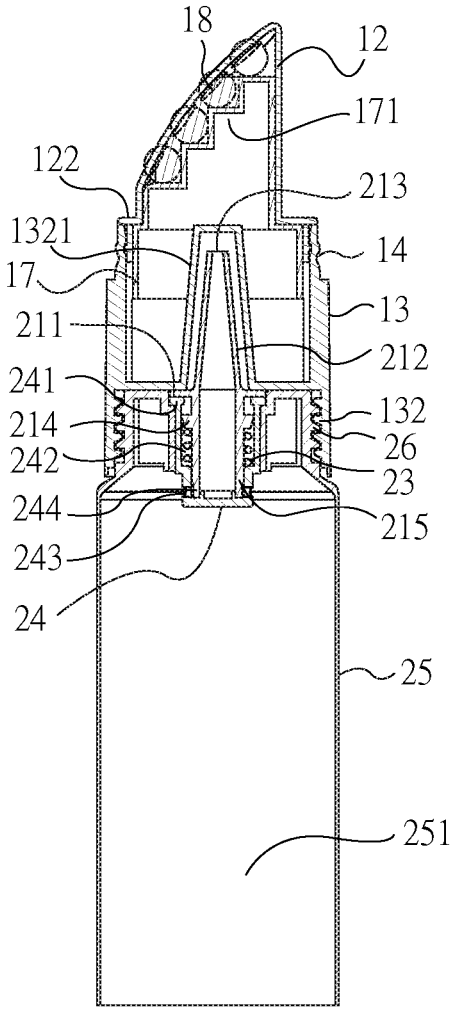
FIG. 6 is a longitudinal sectional view of an applicator according to a third preferred embodiment of the invention.
Figure 7:
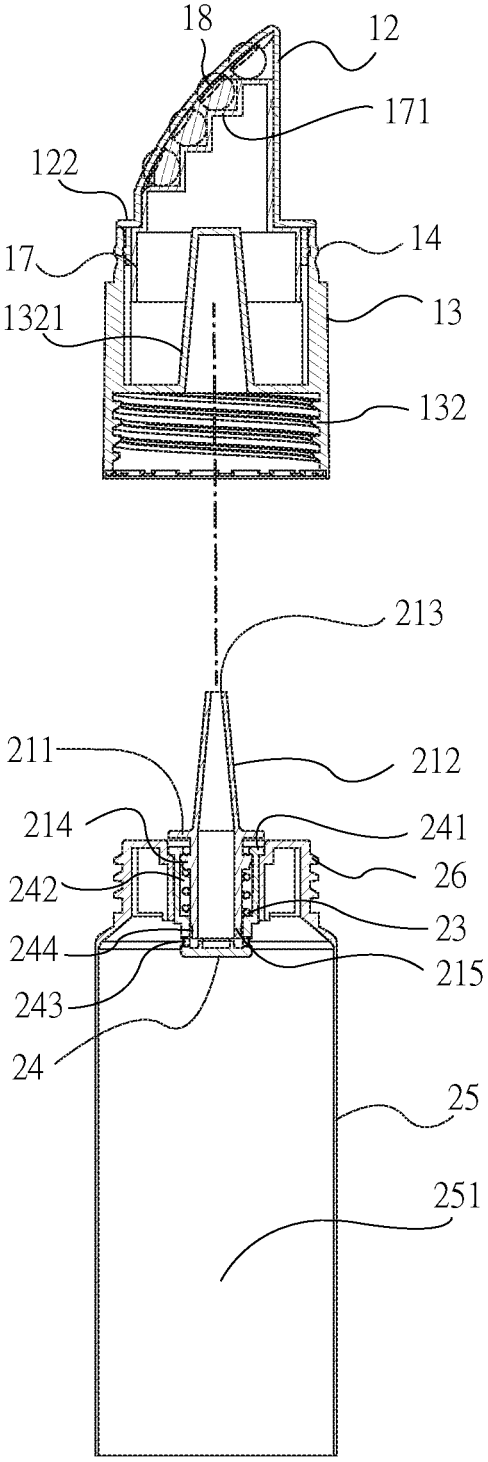
FIG. 7 is an exploded view of the applicator shown in FIG. 6.

Referring to FIGS. 6 and 7 in conjunction with FIG. 4, an application of the fluid material is described below. First, the internally threaded member 132 is counterclockwise threaded to disengage from the externally threaded neck 26. Thus, the flange 211 is not fastened by the coupling member 13. And in turn, the energized torsion spring 23 expands to push the discharging member 21 upward until the fastening element 214 is stopped by the rim 241. A moving distance of the fastening element 214 is defined as a moving distance of the discharging member 21 in the application. Thereafter, the decreased diameter channel 243 is not blocked by the main section 215. Thus, the fluid material in the space 251 flows through the check valve 244, the discharging member 21, the discharging collar 212 and the opening 213. It is noted that the check valve 244 can prevent the fluid material from flowing back to the space 251. Next, the internally threaded member 132 is clockwise threaded into engagement with the externally threaded neck 26. Thereafter, a user may put the housing 12 on the desired body parts. The fluid material can be evenly distributed by the roller-balls 18 and an application face 16 of the inclined surface 121. Thus, a rolling of the roller-balls 18 may apply the fluid material on the body parts while massaging same. After the application, the user may disengage the coupling member 13 from the bottle 25. Finally, the user may clean the housing 12. Otherwise, microorganisms may grow on the roller-balls 18.

Figure 8:
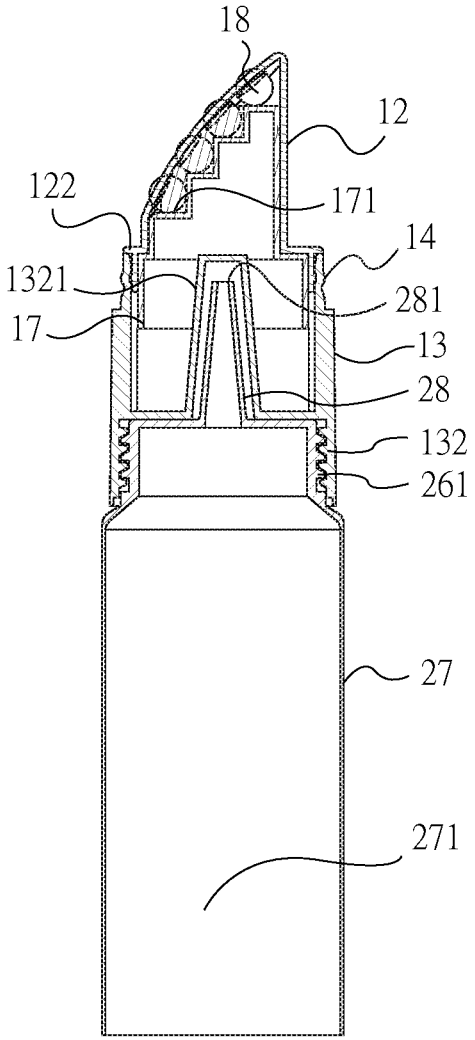
FIG. 8 is a longitudinal sectional view of an applicator according to a fourth preferred embodiment of the invention.
Figure 9:
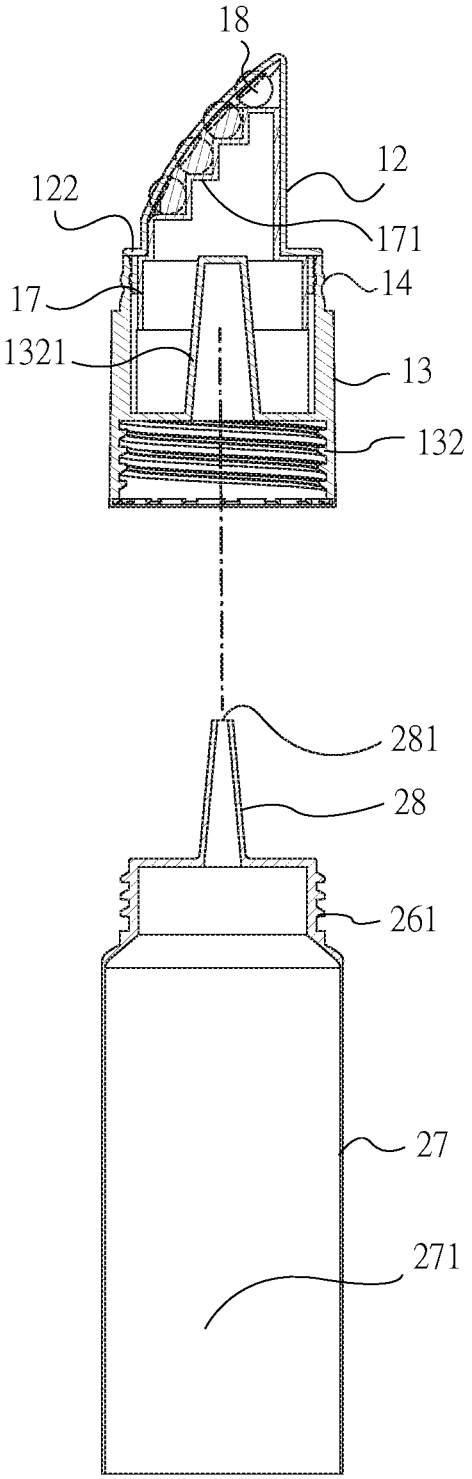
FIG. 9 is an exploded view of the applicator shown in FIG. 8.

Referring to FIGS. 8 and 9 in conjunction with FIGS. 1, 2, 3 and 5, differences between this embodiment and that described in FIGS. 6 and 7 are detailed below. The container assembly 201 has a tapered discharging collar 28 at one end and a bottle 27 at the other end. The bottle 27 has an internal space 271. The bottle 27 and the discharging collar 28 are formed integrally. An opening 281 is defined at an end of the discharging collar 28. An externally threaded neck 261 is formed on the bottle 27 adjacent to the discharging collar 28. The externally threaded neck 261 can be threaded into engagement with the internally threaded member 132.

Figure 5:
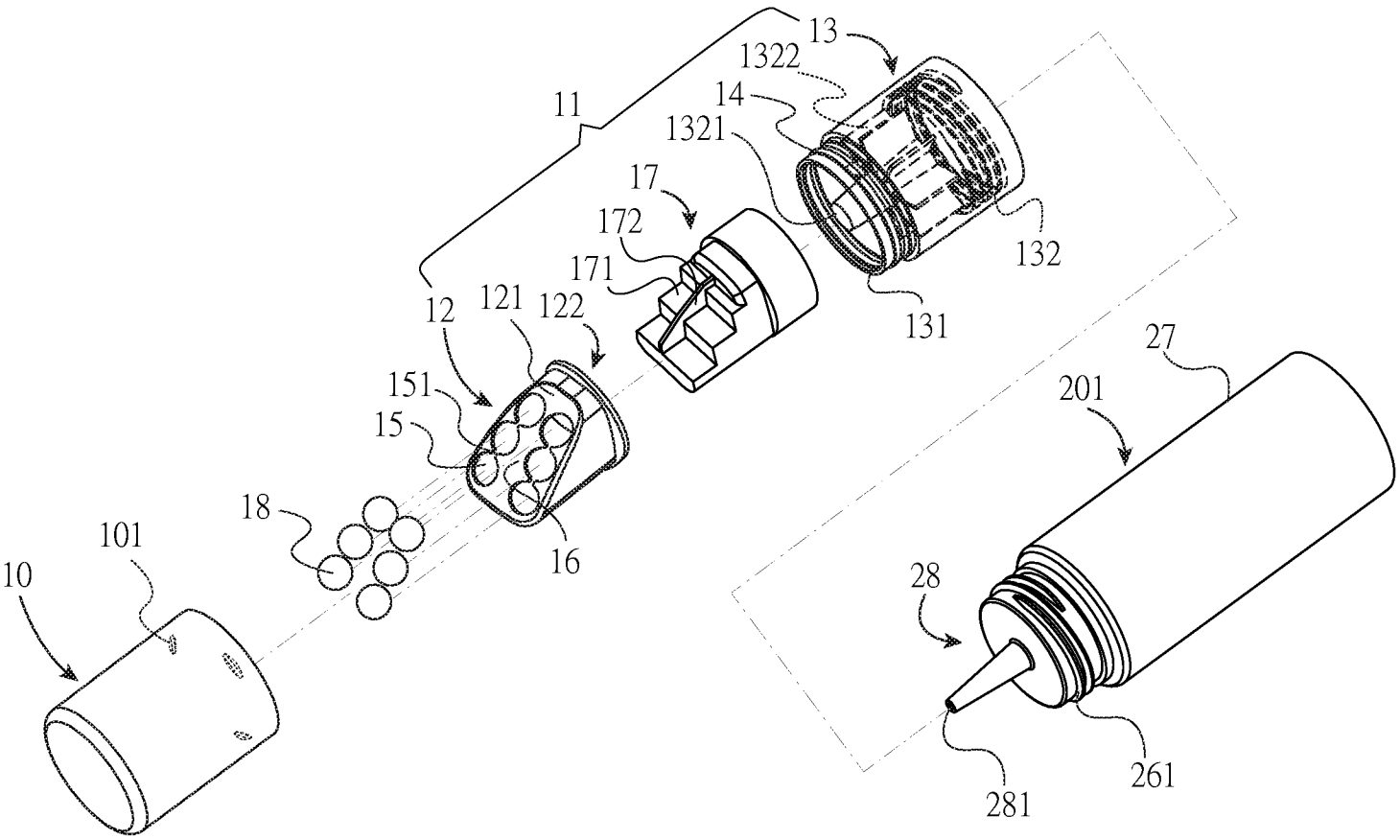
FIG. 5 is exploded view of an applicator according to a second preferred embodiment of the invention.

Referring to FIGS. 8 and 9 in conjunction with FIGS. 4 and 5, an application of the fluid material is described below. First, the internally threaded member 132 is counterclockwise threaded to disengage from the externally threaded neck 261. A user may squeeze the bottle 27 to dispense the fluid material in the space 271 through the opening 281 of the discharging collar 28. Next, the internally threaded member 132 is clockwise threaded into engagement with the externally threaded neck 261. Thereafter, the user may put the housing 12 on the desired body parts. The fluid material can be evenly distributed by the roller-balls 18 and the application face 16. Thus, a rolling of the roller-balls 18 may apply the fluid material on the body parts while massaging same. After the application, the user may disengage the coupling member 13 from the bottle 27. Finally, the user may clean the housing 12. Otherwise, microorganisms may grow on the roller-balls 18.

Figure 12:
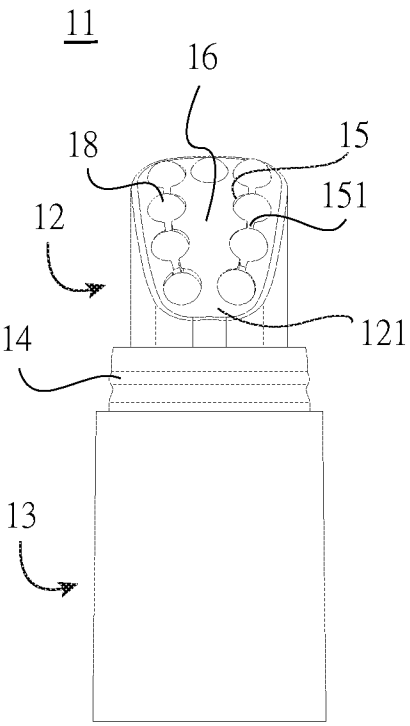
FIG. 12 is a side elevation of an applicator according to a fifth preferred embodiment of the invention.
Figure 11:
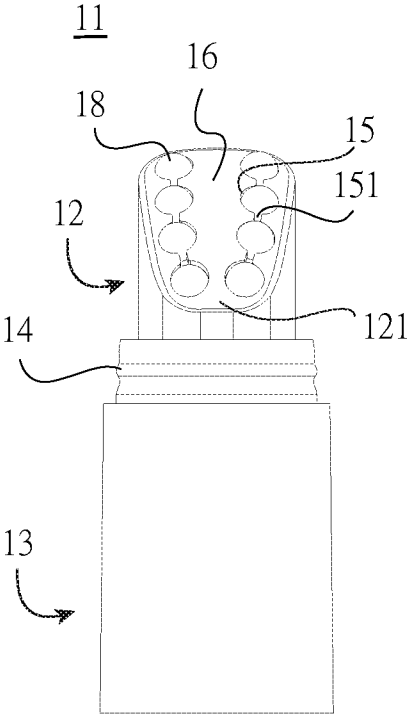
FIG. 11 is a side elevation of the applicator of the third preferred embodiment of the invention.
Figure 10:
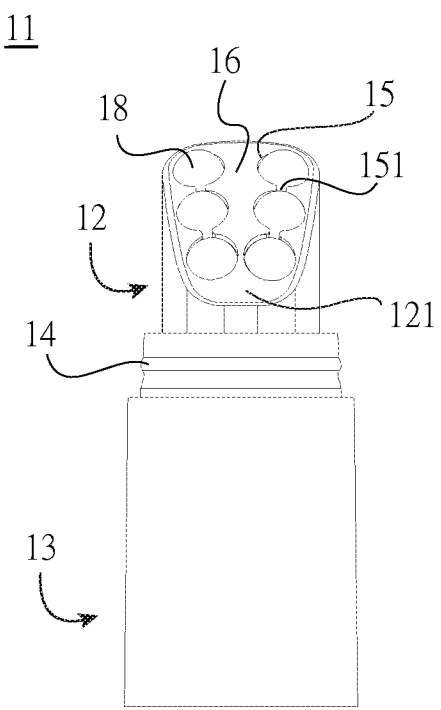
FIG. 10 is a side elevation of the applicator of the first preferred embodiment of the invention.

Referring to FIGS. 10, 11 and 12, upper and lower ends of the inclined surface 121 are parallel to each other and two sides thereof are tapered from top to bottom. Thus, the inclined surface 121 has a wide upper end and a narrow lower end. A plurality of grooves 151 are provided in which each groove 151 interconnect two adjacent holes 15 of the same row. The grooves 151 provide an allowance when the holes 15 are deformed.

As shown in FIG. 10 specifically, the housing 12 has six holes 15 on the inclined surface 121 in which three holes 15 are on the left side and another three holes 15 on the right side. The application face 16 is provided between the left side and the right side of the inclined surface 121. This is a first embodiment of the housing 12.

As shown in FIG. 11 specifically, the housing 12 has eight holes 15 on the inclined surface 121 in which four holes 15 are on the left side and another four holes 15 on the right side. The application face 16 is provided between the left side and the right side of the inclined surface 121. This is a third embodiment of the housing 12.

As shown in FIG. 12 specifically, the housing 12 has nine holes 15 on the inclined surface 121 in which four holes 15 are on the left side, another four holes 15 on the right side, and another hole 15 is between the top one of the left holes 15 and the top one of the right holes 15. This is a fifth embodiment of the housing 12.

In each of the embodiments described in FIGS. 10, 11 and 12, the holes 15 are provided adjacent to an edge of the inclined surface 121 so that the fluid material can be evenly distributed on the application face 16.

The application head 11 can be detached from the bottle 25 or 27 of the applicator to be used individually.

While the invention has been described in terms of preferred embodiments, those skilled in the art will recognize that the invention can be practiced with modifications within the spirit and scope of the appended claims.

What is claimed is:

1. An applicator, comprising:

a closure cap including a plurality of retaining members on an inner surface;

an application head including a housing, a support, and a coupling member wherein the housing includes an axial channel with the support substantially disposed therein, an inclined surface having an application face and a plurality of holes, and a plurality of roller-balls disposed in the holes respectively; the support includes a stair adjacent to the holes, and the coupling member includes a neck member at a first end, the neck member being urged against the support, an internally threaded member adjacent to a second end and disposed through the neck member, a mating retaining member disposed on an outer surface of the neck member between the inclined surface and the internally threaded member, the mating retaining member being secured to the retaining members; and a container assembly including an externally threaded neck at one end;

wherein the internally threaded member is configured to thread into engagement with the externally threaded neck.

2. The applicator of claim 1, wherein upper and lower ends of the inclined surface are parallel to each other and two sides thereof are tapered from top to bottom so that the inclined surface has a wide upper end and a narrow lower end; further comprising a plurality of grooves each interconnecting two adjacent ones of the holes of the same row.

3. The applicator of claim 1, further comprising a wall disposed on the stair to divide each level of the stair into left and right units aligned with the holes respectively.

4. The applicator of claim 1, wherein the coupling member further comprises an axial rod having a plurality of equally spaced blades on a surface, the blades being urged against an end of the support.

5. The applicator of claim 1, wherein the container assembly further comprises a discharging member including an intermediate annular flange, a discharging collar extending from the intermediate annular flange to terminate at a first end, the discharging collar defining an opening, a main section at a second end, and a fastening element between the intermediate annular flange and the main section; a hollow body defining an axial space and having an externally extending rim at a first end, the externally extending rim being securely put on the fastening element, a decreased diameter channel at a second end, and a check valve disposed through the decreased diameter channel; a biasing member disposed in the axial space and put on the main section; and a bottle including an internal space for containing a fluid material; and wherein the externally threaded neck is disposed on an outer surface of the bottle.

6. The applicator of claim 1, wherein the container assembly includes a tapered discharging collar at one end, a bottle at the other end, the bottle having an internal space and being formed integrally with the tapered discharging collar; wherein the tapered discharging collar defines an opening at an end; and wherein the externally threaded neck is disposed on an outer surface of the bottle adjacent to the tapered discharging collar.

* * * * *